United States Patent [19]

Wandell

[11] 4,086,968

[45] May 2, 1978

[54] PILE DRIVER

[75] Inventor: George C. Wandell, Overland Park, Kans.

[73] Assignee: Conmaco, Inc., Kansas City, Kans.

[21] Appl. No.: 766,924

[22] Filed: Feb. 9, 1977

[51] Int. Cl.[2] ..... B25D 9/00

[52] U.S. Cl. ..... 173/115; 91/277

[58] Field of Search ..... 91/262, 277, 352; 173/115, 127, 134

[56] References Cited

U.S. PATENT DOCUMENTS

| | | | |
|---|---|---|---|
| 1,093,210 | 4/1914 | Schalscha | 91/352 |
| 1,226,272 | 5/1917 | Sturtevant | 173/127 |
| 1,917,066 | 7/1933 | Schalscha | 173/127 |
| 2,885,862 | 5/1959 | Smith | 91/352 X |
| 3,357,315 | 12/1967 | Adams et al. | 91/277 |
| 3,566,977 | 3/1971 | Wandell | 91/277 |

*Primary Examiner*—Lawrence J. Staab
*Attorney, Agent, or Firm*—John A. Hamilton

[57] ABSTRACT

In a pile driving hammer including a striker elevatable on guides by fluid pressure delivered to an operating fluid cylinder, and capable of being dropped to deliver a pile driving blow by exhausting fluid from the cylinder, a control system for the cylinder including a first cam carried by the striker and operable to cause delivery of fluid to the cylinder at the lower end of the stroke of the striker, a plurality of second cams carried by the striker and operable to cause exhaust of fluid from the cylinder at respectively different elevations of the striker, and remotely controlled apparatus for activating any selected one of the second cams.

2 Claims, 7 Drawing Figures

PILE DRIVER

Figure 1:
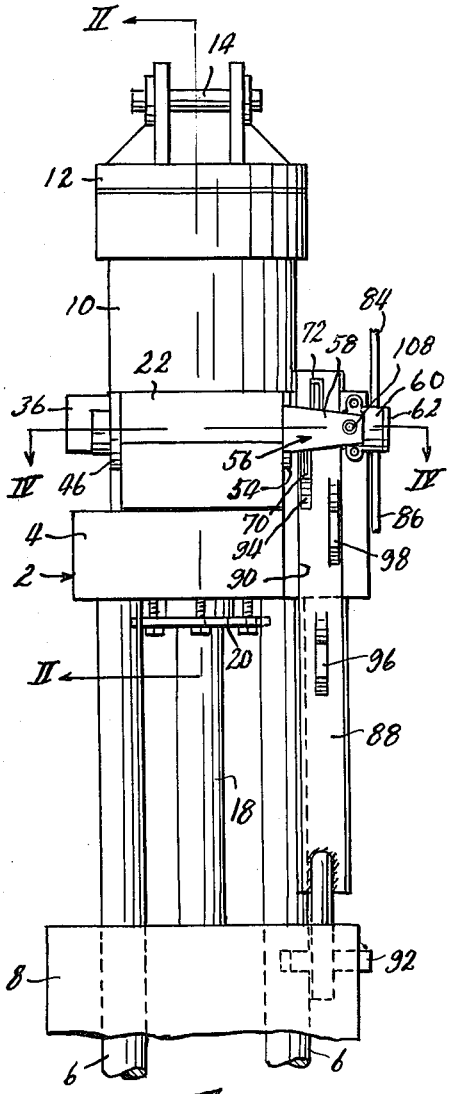

This invention relates to new and useful improvements in power hammers of the class commonly known as pile drivers, and relates particularly to a means operable to vary the power or energy delivered by each stroke of the hammer.

Due to the nature and construction of piles coming into more common usage, particularly concrete piles, which must be driven into substructure by a pile driver hammer, it has become increasingly necessary and desirable, in order to preserve the structural integrity of the pile itself, that the pile be driven initially by relatively light strokes of the hammer, while heavier blows are permissable after the pile is well-started into the substructure. Most commonly, the striker or ram of the hammer is elevated by fluid pressure delivered to an operating cylinder forming an element of the hammer, and allowed to drop to deliver a pile-driving blow by exhausting fluid from said operating cylinder. With this type of operation, it is of course obvious that the energy delivered by each stroke of the hammer can be varied as desired by changing the elevation to which the striker is raised before it is allowed to drop, since the energy delivered is a function of the mass and velocity of the striker at the instant of the blow, and the velocity thereof is a function of the distance it is allowed to drop before delivering the blow. Methods and apparatus have in fact been previously proposed for adjusting the stroke of the striker for the purposes stated, but generally these prior methods and apparatuses have required that a workman climb to the hammer to accomplish the necessary adjustments. Since the hammer is normally suspended by a crane at considerable elevations, this operation is both hazardous and time-consuming.

Accordingly, the primary object of the present invention is the provision of a pile driver hammer including means whereby the hammer stroke may be shortened or lengthened by remotely controlled means.

Another object is the provision of a pile driver of the character described wherein the stroke-controlling mechanism is of improved construction whereby to contribute to dependable, efficient and trouble-free operation.

Generally, these objects are accomplished by the provision of an operating cylinder to which fluid pressure is supplied by a control valve operable in a first position to deliver fluid to the cylinder to raise the striker, and in a second position to exhaust fluid from the cylinder to allow the striker to drop. The valve is of a rotary type, operated by turning a stem projecting therefrom. A pair of cam followers are mounted nonrotatably on said stem, and are engaged to turn said stem by fixed cams mounted on a cam bar fixed to the striker and movable laterally past said valve stem. One of the cam followers is fixed longitudinally on the stem, and is engaged by one of the cam bar cams to turn the valve to said first position each time the striker reaches the bottom of its stroke. The other of said cam followers is movable longitudinally along the valve stem whereby to be engaged selectively by either of two other cams of the cam bar to turn the valve to its second position to exhaust the cylinder, said other cams being disposed at different positions longitudinally of the cam bar, whereby they cause exhausting of the cylinder at different points in the elevation of the striker. The movable cam follower is carried by a hollow piston rod slidable on the valve stem, which is connected to a piston movable in a control cylinder mounted on the hammer frame coaxially with the valve stem. Thus selective delivery of fluid pressure to either end of said control cylinder will move the movable cam follower as desired. Fluid pressure to said control cylinder may be supplied by flexible hoses which may be extended to any desired remote location.

Other objects are simplicity and economy of construction, and efficiency and dependability of operation.

Figure 2:
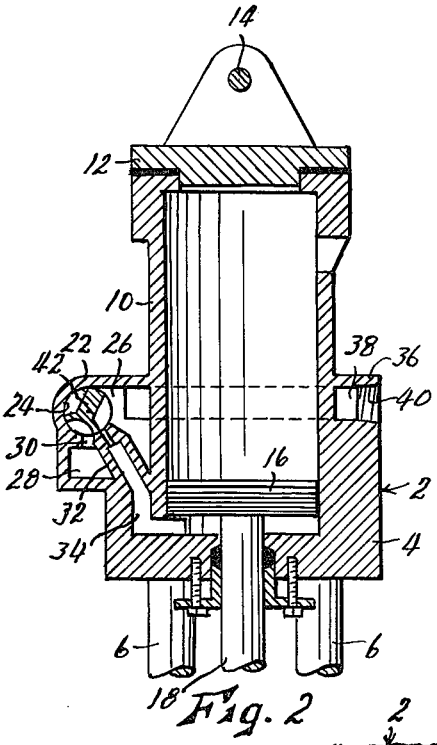
Figure 3:
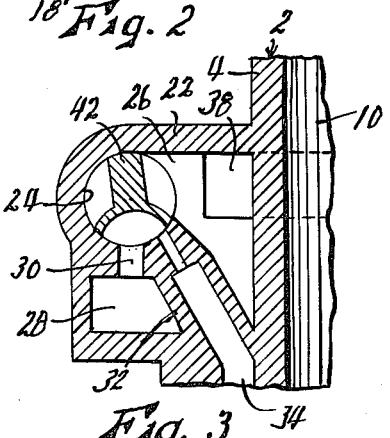
Figure 4:
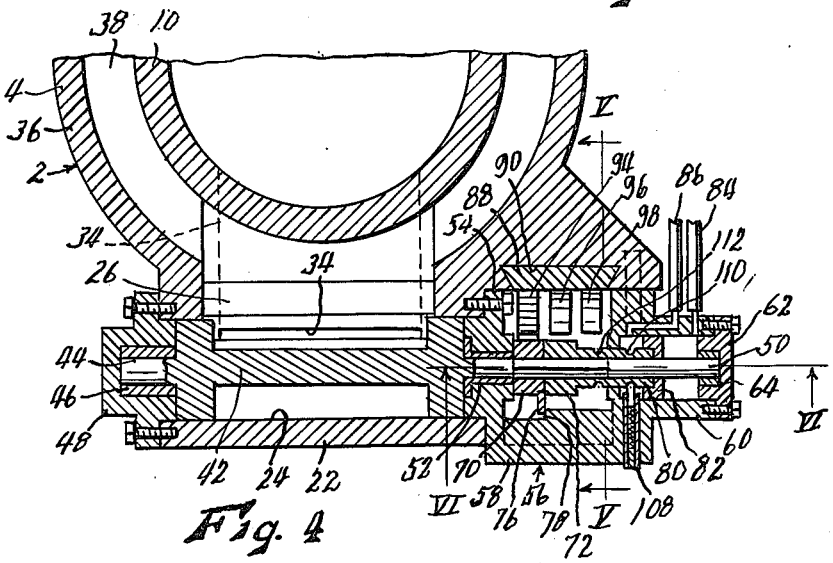
Figure 5:
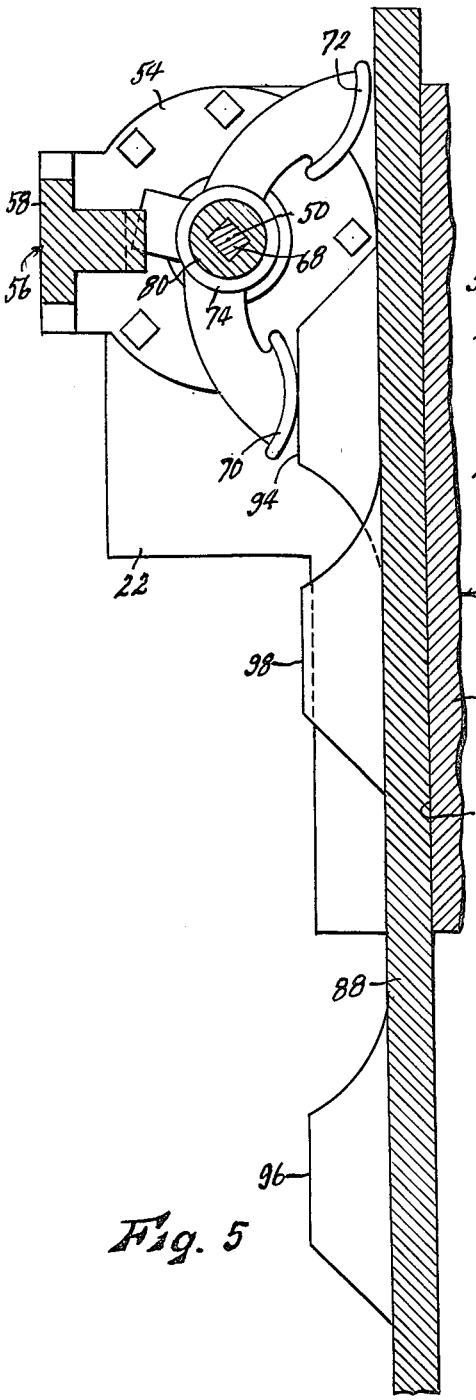
Figure 6:
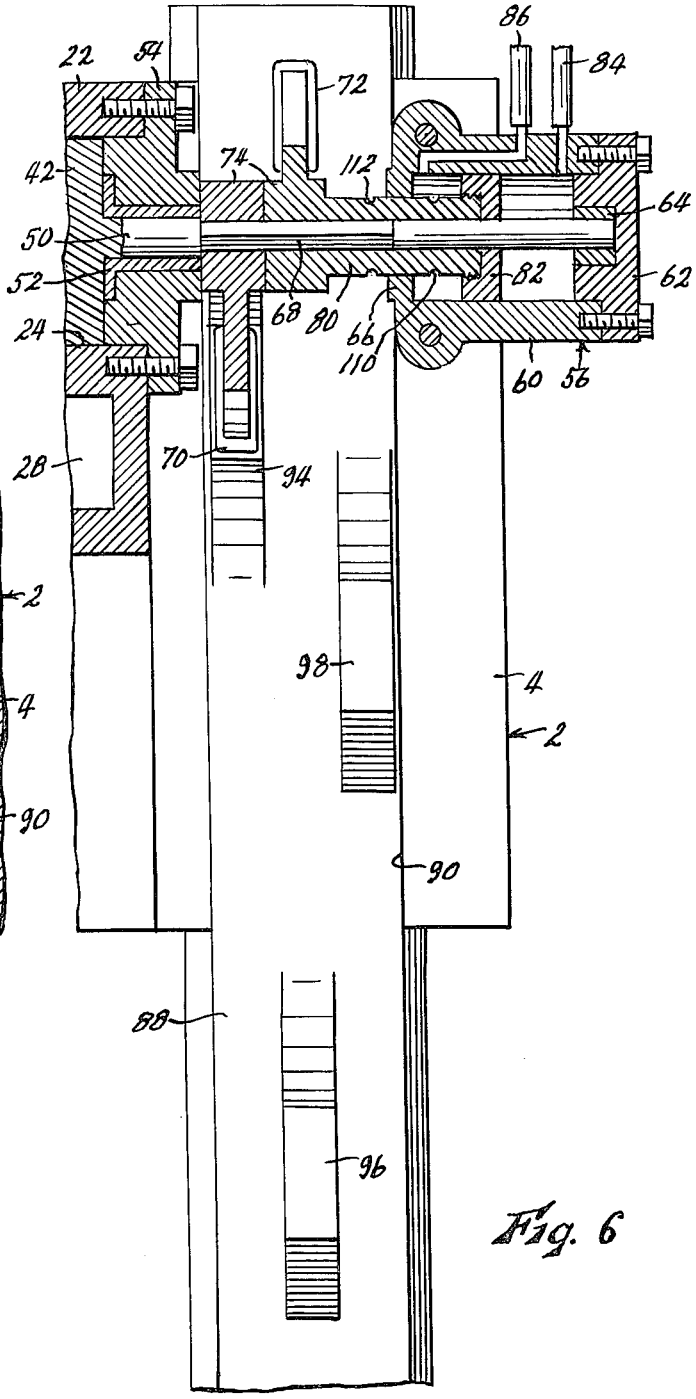
Figure 7:
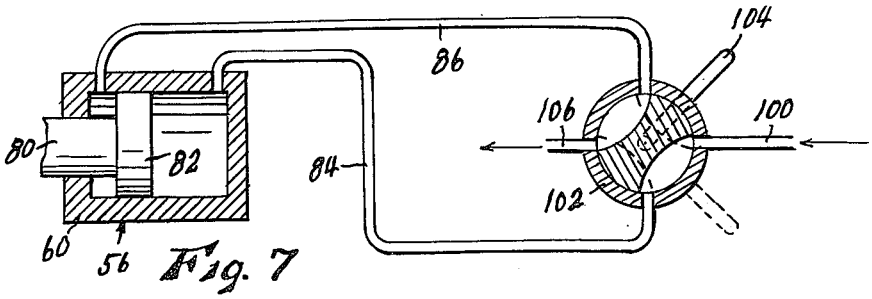

With these objects in view, as well as other objects which will appear in the course of the specification, reference will be had to the accompanying drawing, wherein:

FIG. 1 is a fragmentary side elevational view of a pile driver embodying the present invention, showing the striker at the lower limit of its travel, FIG. 2 is a fragmentary sectional view taken on line II—II of FIG. 1, with the control valve positioned to cause elevation of the striker, FIG. 3 is an enlarged fragmentary view similar to FIG. 2, but with the control valve positioned to exhaust the cylinder and drop the striker, FIG. 4 is an enlarged, fragmentary sectional view taken on line IV—IV of FIG. 1, FIG. 5 is an enlarged, fragmentary sectional view taken on line V—V of FIG. 4, FIG. 6 is an enlarged, fragmentary sectional view taken on line VI—VI of FIG. 4, and FIG. 7 is a diagrammatic layout of the control system.

Like reference numerals apply to similar parts throughout the several views, and the numeral 2 applies generally to the frame of the pile driver, said frame consisting of an upper head 4, a plurality of columns or posts 6 affixed at their upper ends in said head and depending therefrom in parallel relation, and a lower head, not shown, in which the lower ends of posts 6 are affixed. A striker 8, shown fragmentarily, is mounted slidably on posts 6 for vertical movement therealong. Although not shown and not pertinent to the present invention, it will be understood that striker 8 carries a hammer head at its lower surface which, when the striker is at the bottom of its stroke, projects into an aperture of the lower head to deliver hammer blows to the upper end of a pile to be driven, or to an anvil positioned on and supported by the pile. The drawing shows striker 8 at the bottom of its stroke.

Formed integrally with upper head 4 is a fluid operating cylinder 10 which extends upwardly from and parallel with posts 6, and is closed at its upper end by a cap 12 suitably fixed thereto, said cap carrying a horizontal pin 14 by which the entire assembly may be supported from a crane or the like. Operable in cylinder 10 is a piston 16 to which is affixed a piston rod 18 which projects downwardly through a seal 20 in the lower end of the cylinder, and is affixed at its lower end to striker 8. Thus the striker is raised and lowered by the action of piston 16 in cylinder 10.

Also formed integrally with upper head 4 is a lateral enlargement 22, in which is formed a cylindrical valve chamber 24 which extends horizontally and transversely to the axis of cylinder 10, an inlet chamber 26 which opens into valve chamber 24, and an outlet chamber 28 which also opens into valve chamber 24 through passage 30 and which is open to the atmosphere. Inlet and outlet chambers 26 and 28 are divided angularly of chamber 24 by a fixed wall 32 in which is formed a passageway 34 interconnecting valve chamber 24 with the lower end of cylinder 10, beneath piston 16. A fluid chest 36 also integral with the upper head surrounds cylinder 10, and forms a passageway 38 which opens into inlet chamber 26, and connects with an inlet opening 40 at the opposite side of the cylinder, which is adapted to receive a hose or other flexible conduit for delivering pressurized fluid, usually either steam or compressed air, to the pile driver.

Mounted snugly for rotation in valve chamber 24 is a valve spindle 42 which is so configured that when turned in a clockwise direction to the position shown in FIG. 2 it seals the outlet and interconnects inlet chamber 26 to passageway 34, hence delivering pressurized fluid to the lower end of cylinder 10 to raise piston 16 and hence to elevate striker 8. When the spindle is turned in a counter-clockwise direction to the position shown in FIG. 3, inlet chamber 26 is sealed, and exhaust passageway 34 is connected through passage 30 and outlet chamber 28 to the atmosphere, so that piston 16 and striker 8 fall by gravity to deliver a hammer blow. The flow capacity of the exhaust passage is sufficiently great to insure a virtually free fall of the striker. One end of spindle 24 is provided with an axial stem 44 journalled in a bearing 46 mounted in a cap 48 affixed to and sealing the associated end of valve chamber 24. The other end of spindle 42 is provided with an axially extending stem 50 whch is journalled in a bearing 52 mounted in a cap 54 affixed to and sealing the associated end of the valve chamber, and extends outwardly past said cap.

Cap 54 forms one element of a one-piece, integral bracket 56 which additionally includes an arm 58 parallel with but radially offset from valve stem 50, and a control cylinder 60 coaxial with but outwardly spaced from cap 54. The outer end of control cylinder 60 is sealed by a cap 62 in which is mounted a bearing 64 within which the outer end of valve stem 50 is journalled. Between cap 54 and the inner end wall 66 of control cylinder 60, valve stem 50 is squared, as best indicated in FIGS. 5 and 6 at 68. Carried on the squared section 68 of the valve stem are a pair of generally radially extending cam followers 70 and 72, each having a hub 74 with a squared aperture engaged slidably but non-rotatably on stem section 68. Follower 70, the hub of which abuts cap 54, is provided with a radial tab 76 on its hub (see FIG. 4) which rotatably engages a shoulder 78 formed on bracket arm 58, so that the position of follower 70 along the valve stem is fixed. The hub 74 of cam follower 72 is axially slidable along the valve stem being provided for this purpose with an outward coaxial tubular projection 80 axially slidable on the valve stem and constituting a hollow piston rod. Said piston rod extends slidably through the inner end wall 66 of control cylinder 60 and into said cylinder, and an annular piston 82 operable in said cylinder is affixed to the extended end of piston rod 80. Thus, as indicated diagrammatically, cam follower 72 is moved inwardly to the position shown in FIG. 6 by delivery of fluid under pressure to the outer end of cylinder 60 through flexible hose 84, and is moved outwardly by the delivery of fluid under pressure to the inner end of cylinder 60 through flexible hose 86.

A vertical cam bar 88 is carried for vertical sliding movement in a dovetailed groove 90 formed therefor in a vertical surface of upper head 4, and is affixed at its lower end to striker 8, as by a key 92 (see FIG. 1). Thus the cam is moved upwardly and downwardly by the vertical reciprocation of the striker. The exposed outer face of said cam bar is transversely coincident with the squared section 68 of the valve stem, but is horizontally spaced apart therefrom. Welded or otherwise affixed on said cam bar are three cams 94, 96 and 98, spaced laterally across the face of said cam bar, and each positioned to engage one of cam followers 70 or 72 at some point in the vertical movement of the cam bar, whereby to turn valve stem 50 in one direction or the other about its axis. Cam 94 is positioned near the upper end of the cam bar whereby to engage and deflect follower 70 only at the bottom of the movement of striker 8. This deflection turns valve stem 50 in a clockwise direction, as viewed in FIGS. 2 and 3, to position valve spindle 42 in the FIG. 2 position, whereby to deliver pressurized fluid beneath operating piston 16 to elevate the striker. This operation occurs at the same lowermost position of the striker in each cycle of operation. Cam 96 is positioned laterally of the cam bar to engage follower 72 when said follower is in its inward position as shown in FIG. 6, and cam 98 is positioned laterally of the cam bar to engage follower 72 when said follower is in an outward position adjacent control cylinder 60. The deflection of follower 72 by either of cams 96 or 98 turns valve stem 50 and valve spindle 42 in a counter-clockwise direction, as viewed in FIGS. 2 and 3, to the FIG. 3 position, whereby fluid under operating piston 16 is exhausted to the atmosphere as previously described, and striker 8 drops. Cam 96 is positioned at such a distance below follower 72 that the striker is lifted through a full or normal stroke before it is dropped by the action of said cam, while cam 98 is positioned vertically intermediate cams 94 and 96 so that the striker is elevated to a lesser distance before it is dropped by the action of that cam.

Fluid under pressure for operating piston 82 in control cylinder is supplied, as shown diagrammatically in FIG. 7, from a suitable source 100 to a selector valve 102, which may be disposed at any desired location remote from the pile driver itself. Said selector valve is provided with a manual operating handle 104. When said handle is in the position shown in solid lines, fluid from source 100 is directed through hose 84 to the outer end of control cylinder 60, moving piston 82 inwardly to position cam follower 72 in its inward position as shown in FIG. 6, whereby to be activated by cam 96 to provide a full normal stroke of striker 8, while fluid behind piston 82 is exhausted through hose 86 and valve 102 to atmosphere at 106. When handle 104 is moved to its dotted line position fluid from source 100 is delivered through hose 86 to the inner end of cylinder 60, moving piston 82 outwardly to position follower 72 in its outward position adjacent cylinder end wall 66, whereby to be actuated by cam 98 to provide a reduced stroke of striker 8. Cam follower 72 may be secured releasably in either its inward or outward positions by a spring detent 108 mounted in bracket 56 and engageable selectively in a pair of peripheral grooves 110 and 112 (see FIG. 6) formed in the piston rod portion 80 of said follower.

In operation, it will be seen that each time striker 8 reaches the lower limit of its stroke and delivers a hammer blow, cam 94 engages and deflects cam follower 70 to turn valve stem 50 and valve spindle 42 to deliver pressurized fluid beneath operating piston 16 to raise the striker. As the striker is elevated, and if follower 72 is aligned with cam 96 as in FIG. 6, cam 96 engages and deflects follower 72 only after the striker has been lifted through a full stroke, thereby turning valve stem 50 and spindle 42 to exhaust fluid beneath piston 16 to atmosphere, whereby the striker drops to deliver a full-strength hammer blow. On the other hand, if follower 72 has been aligned with cam 98, cam 98 engages follower 72 to operate valve spindle 42 to drop the striker after only a reduced elevation, whereby it delivers a hammer blow of reduced energy. The selective alignment of cam follower 72 with either cam 96 or cam 98 is accomplished by control cylinder 60 and piston 82, as already described, under the control of manual selector valve 102.

Thus it will be apparent that a pile driver has been produced which accomplishes the desired objectives. It is capable of delivering hammer blows selectively either of a greater energy or of reduced energy, a requirement which as previously discussed is becoming more and more prevalent. The selection of hammer blows of the desired energy may be made from a convenient position remote from the pile driver itself, thus eliminating the hazardous and time-consuming necessity of a workman climbing to the pile driver itself to make the required adjustments. The structure is simple, economical and efficient. The movement of adjustable cam follower 72 by direct connection thereof to a fluid cylinder coaxial therewith eliminates most of the structural weaknesses and possible sources of malfunction which would be inherent in any other remotely controlled apparatus for moving and controlling said follower.

While I have shown and described a specific embodiment of my invention, it will be readily apparent that many minor changes of structure and operation could be made without departing from the spirit of the invention.

What I claim as new and desire to protect by Letters Patent is:

1. A pile driver comprising:

a. a frame, b. a striker vertically movable in said frame, c. an operating cylinder formed vertically in said frame, d. a piston operable in said cylinder, e. means connecting said piston to said striker whereby said striker is raised by elevation of said piston, f. a valve chamber formed in said frame, g. a two-position valve member mounted movably in said valve chamber, h. first and second passageways formed in said cylinder and connecting said valve chamber respectively to said cylinder beneath said piston and to atmosphere, i. means for supplying pressurized fluid to said valve chamber, said valve member having a first position delivering said fluid to said first passageway, whereby said piston is elevated, and a second position interconnecting said first and second passageways, whereby fluid beneath said piston is exhausted to atmosphere and said piston is released, j. a valve stem affixed to said valve member and projecting from said valve chamber in a direction transverse to the direction of movement of said piston, and operable by turning thereof in relatively opposite directions to move said valve member between its first and second positions, k. a cam bar carried slidably by said frame for longitudinal movement parallel to the movement of said piston, affixed at one end to said striker to be movable therewith, and extending transversely past said valve stem in spaced relation therefrom, l. a first cam follower mounted non-rotatably on said valve stem and projecting radially therefrom, m. a first cam fixed on said cam bar and operable to engage and deflect said first follower as said piston approaches the bottom of its stroke, whereby to turn said valve stem to move said valve member to its first position, n. a second cam follower mounted non-rotatably on and for axial sliding movement along said valve stem, o. second and third cams fixed on said cam bar in transversely spaced relation thereon and operable to engage and deflect said second follower, whereby to turn said valve stem to move said valve member to its second position, at respectively different elevations of said piston, the cam actually engaging said second follower depending on the position of said second follower longitudinally along said valve stem, p. a fluid pressure control cylinder mounted on said frame coaxially with said valve stem, q. an extension fixed to said second follower and projecting coaxially therefrom into said control cylinder, r. a piston operable in said control cylinder and affixed to the extended end of said follower extension, and s. remotely operable means operable to supply pressurized fluid to said control cylinder selectively at either side of the piston therein, whereby said second cam follower may be shifted selectively into operative alignment either with said second cam or said third cam.

2. A pile driver as recited in claim 1 wherein the piston rod extension of said second cam follower, and the piston of said control cylinder, are axially tubular, said valve stem projecting therethrough and being journalled at its extreme extended end in a bearing provided therefor at the distal end of said control cylinder.

* * * * *